US006508513B1

(12) United States Patent
Hall et al.

(10) Patent No.: US 6,508,513 B1
(45) Date of Patent: Jan. 21, 2003

(54) PORTABLE ARM REST

(76) Inventors: Blondell Hall, 3000 NW. 160th St., Miami, FL (US), 33054; Latasha LeCounte, 3000 NW. 160th St., Miami, FL (US) 33054

( * ) Notice: Subject to any disclaimer, the term of this patent is extended or adjusted under 35 U.S.C. 154(b) by 0 days.

(21) Appl. No.: 10/026,285

(22) Filed: Dec. 21, 2001

(51) Int. Cl.[7] ..... A47C 7/54
(52) U.S. Cl. ..... 297/411.25; 297/398; 297/411.4
(58) Field of Search ..... 297/411.23, 411.25, 297/411.24, 411.29, 411.3, 411.32, 411.33, 411.35, 411.4, 394, 397, 398, 399, 400, 403

(56) References Cited

U.S. PATENT DOCUMENTS 3,148,914 A * 9/1964 Steely
3,393,938 A * 7/1968 Meyer et al.
5,975,638 A * 11/1999 Schreiner
6,164,725 A * 12/2000 Santa Cruz et al.
6,217,119 B1 * 4/2001 Cook et al.

FOREIGN PATENT DOCUMENTS

JP 6-38855 * 2/1994

* cited by examiner

*Primary Examiner*—Laurie K. Cranmer
(74) *Attorney, Agent, or Firm*—J. Sanchelima; A. Bordas

(57) ABSTRACT

A portable arm rest having an adjustable u-shaped frame assembly, which snugly fits upon the rear side of a vehicle seat back. The u-shaped frame assembly has slots for arm members. Able to slide within the slots of the frame assembly, the arm members may lock in place to allow a user to rest one or both arms while seated in the seat. The portable arm rest may be utilized in vehicles such as automobiles, vans, trucks, campers, RVs and the like, where the seats for the driver or passengers do not have a built-in arm rest.

4 Claims, 3 Drawing Sheets

PORTABLE ARM REST

BACKGROUND OF THE INVENTION

1. Field of the Invention

The present invention relates to arm rests, and more particularly, to portable arm rests for vehicles.

2. Description of the Related Art

While riding in a vehicle such as an automobile, it is typically desired by the driver and passengers to be in comfort. Whether driving or riding in the vehicle, it is common for the driver and passengers to rest their arms on an arm rest, if able to do so. Additionally, resting arms, especially while driving, reduces driver fatigue. This is especially true for elderly individuals. Various designs for arm rests have been designed in the past. However, in many vehicle models, arm rests are not included as an option.

There are no portable arm rests to the best of applicant's knowledge, which include an adjustable u-shaped frame assembly, which snugly fits upon the rear side of a vehicle seat back, that is removable, and easily transportable.

SUMMARY OF THE INVENTION

A portable arm rest, comprising a frame assembly having a first frame member with first and second ends and a second frame member with third and fourth ends. The first and second frame members each having a first slot with fifth and sixth ends extending a first predetermined distance from the first and third end, a second predetermined distance towards the second and fourth end respectfully, without reaching the second and fourth end. The fifth end includes a second slot with adjustment means, and the sixth end has a third slot with locking means. The first frame member also has an opening at the first end to receive the third end of the second frame member. The first frame member also has a through opening a third predetermined distance from the first end towards said second end, without reaching the second end.

In addition, an arm assembly has first and second arm members. Each arm member has a bushing extending radially outwardly a fourth predetermined distance. The bushing slidably journals within the first, second, and third slots. The bushing also includes a retainer to secure the bushing within the first, second, and third slots.

The portable arm rest also has width adjusting means for adjusting the width of the frame assembly, so that the frame assembly may be mounted onto a vehicle seat. The width adjusting means includes a knob, insertable through the through opening of the first frame member so that a user exerting a rotational force can secure the first frame member to the second frame member.

The adjustment means includes the bushings swiveling and locking within the second slot, allowing said first and second arm members to rotate from a retracted position to an extracted position and vice-a-versa. The locking means includes the bushing fitting within the third slot, allowing the first and second arm members to lock in place.

It is therefore one of the main objects of the present invention to provide a portable arm rest that may be removably secured to the rear side of a vehicle seat back.

It is another object of the present invention to provide a portable arm rest that is easily transportable.

It is another object of this invention to provide a portable arm rest that may be installed on a variety of vehicle seat backs.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
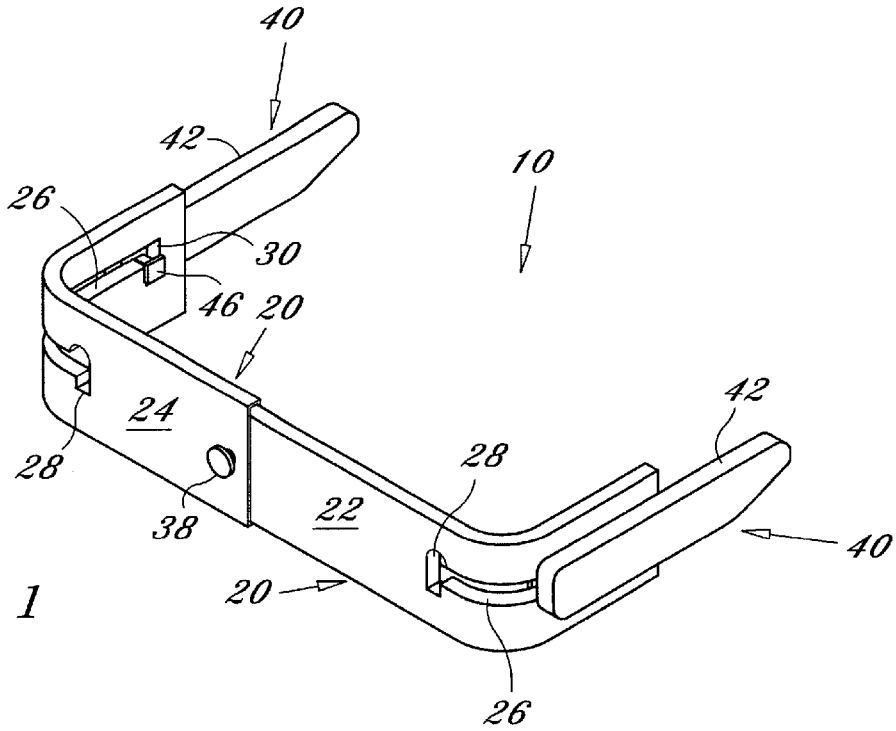
FIG. 1 represents a perspective view of the instant invention with one of the arm members in an extracted and locked position.

Referring now to the drawings, where the present invention is generally referred to with numeral 10, it can be observed that it basically includes frame assembly 20 and arm assembly 40.

As seen in FIG. 1, frame assembly 20 is generally u-shaped and comprises elongated members, defined as frame members 22 and 24. The curvature of frame members 22 and 24 is designed to allow a secure fit when mounted onto the rear side of a vehicle seat back.

The width of frame assembly 20 is adjustable, whereby frame member 22 slides within frame member 24. Once the desired width is obtained, frame member 22 is secured within frame member 24 with knob 38.

Frame members 22 and 24 each have slot 26, which wraps around their respective curved portion. Arm assembly 40 comprises arm members 42. Arm members 42 have bushings 44, seen in FIG. 2, which slide within slot 26 of frame members 22 and 24 to a desired position. As illustrated, one of the arm members 42 is in an extracted and locked position. Arm members 42 lock to the illustrated position when bushings 44 slide within lock slots 30, better seen in FIG. 2. In this position, a user may comfortably rest their arms on arm members 42.

Figure 2:
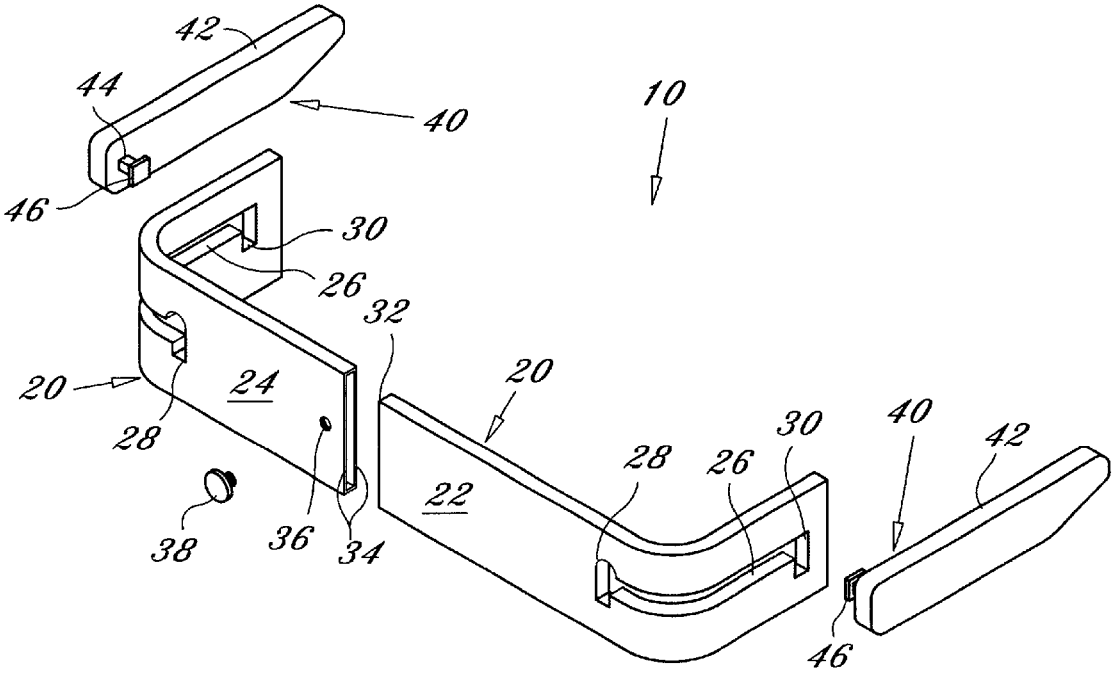
FIG. 2 illustrates an exploded view of the instant invention.

As seen in FIG. 2, frame members 22 and 24 each have an elongated slot, defined as slot 26. Located at one end of slot 26 is adjusting slot 28, which is generally rectangular in shape. In the preferred embodiment, adjusting slot 28 is vertically configured with respect to slot 26, thereby allowing sufficient room for arm member 42 and more specifically bushing 44, to rotate in. Opposite the end of adjusting slot 28, is lock slot 30. Lock slot 30 is also generally rectangular to receive bushing 44 of arm member 42.

Frame member 22 has end 32, which snugly fits within, when received by opening 34 of frame member 24. Near opening 34, frame member 24 has threaded hole 36, which trespasses the outside face of frame member 24. Knob 38 has threads that complement threaded hole 36. The end having threads of knob 38 is inserted into hole 36.

Arm assembly 40 has arm members 42, which are shaped to comfortably support the arms of the user, and more specifically, the elbow and forearm area of the arms. Extending perpendicularly from arm member 42 is bushing 44. In the preferred embodiment, bushing 44 is square in shape, to snugly slide within slot 26 of frame members 22 and 24. At the end of bushing 44, is retainer 46, which is of greater area than the distal end of bushing 44. Retainer 46 keeps arm member 42, and more specifically, bushing 44 within slots 26, 28 and 30.

Figure 3:
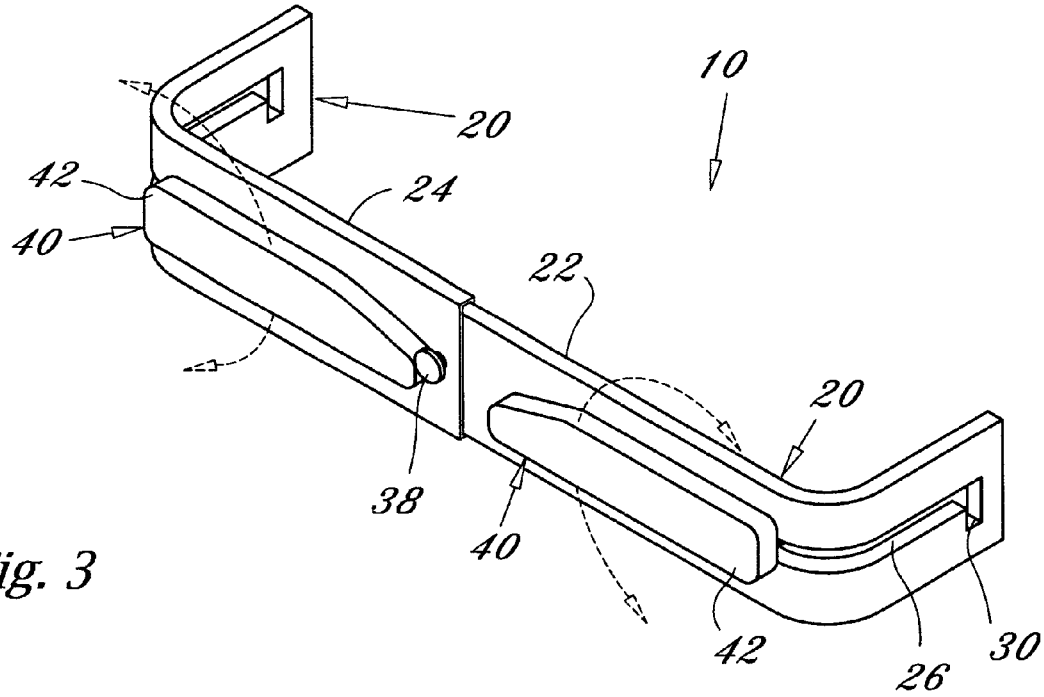
FIG. 3 illustrates the arm members of the instant invention in a retracted and locked position.

As seen in FIG. 3, arm members 42 are in a retracted position and locked within adjusting slot 28, seen in FIG. 2. The illustrated position may be desirable when instant invention 10 is transported, or when the user does not desire to rest his or her arm upon arm member 42. Arm members 42 are independent from one another, whereby either arm member 42, or both, may be extracted and locked to the position illustrated in FIG. 1. With the area defined with adjusting slot 28, arm member 42 may swivel upward or downward approximately 180 degrees until bushing 44 aligns with slot 26, allowing the user to then slide arm member 42 towards lock slot 30.

Figure 4:
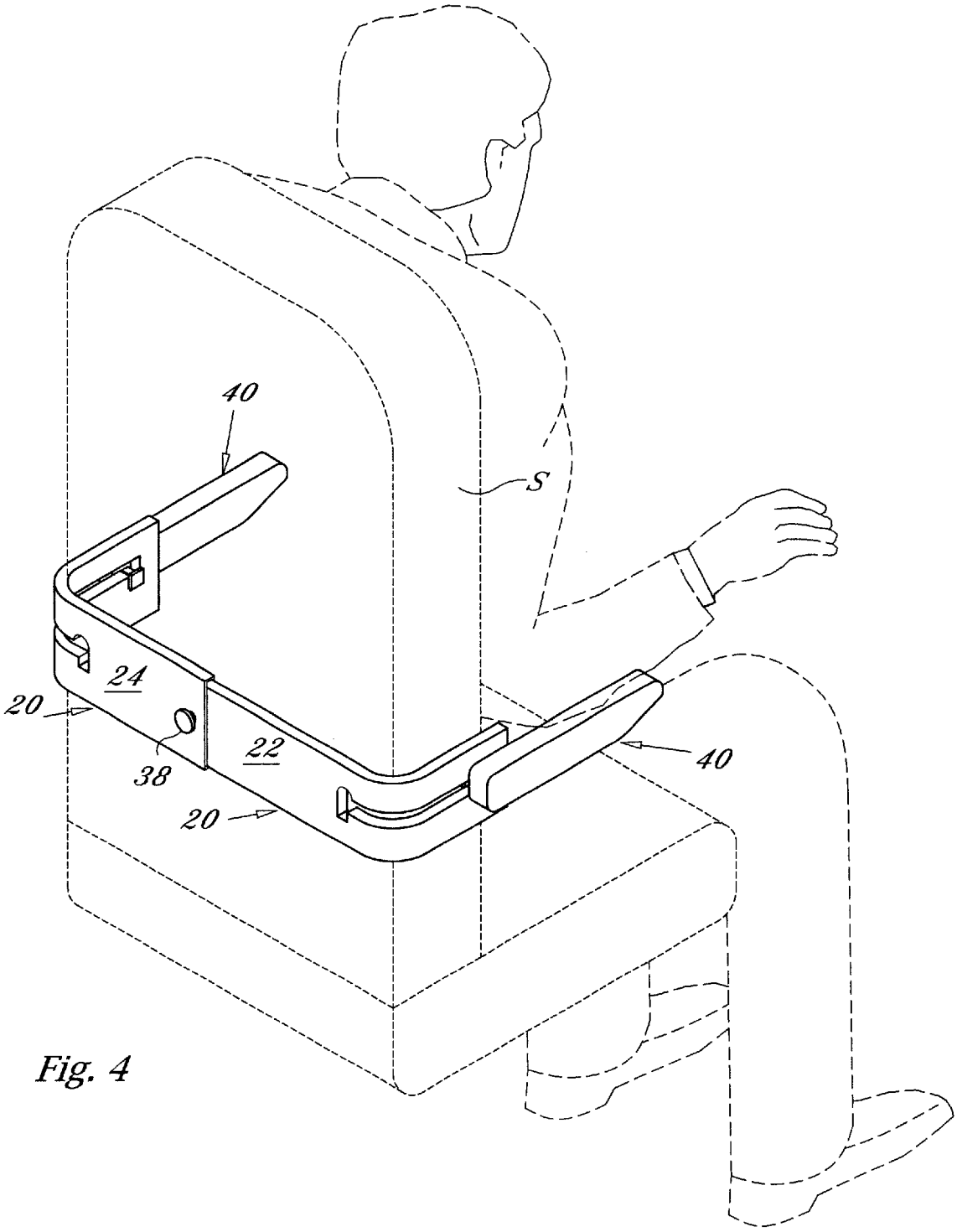
FIG. 4 is a representation of the instant invention mounted onto a vehicle seat back.

As seen in FIG. 4, instant invention 10 is mounted onto a vehicle seat back. To install instant invention 10 onto vehicle seat back S, the user may adjust the width of frame assembly 20. Knob 38 is loosened by turning in a counter-clockwise direction until frame member 22 slides within frame member 24. Once the desired width is obtained, frame assembly 20 is mounted at the desired height upon vehicle seat back S. Knob 38 is then turned clockwise, forcing the threaded end of knob 38 against the outside face of frame member 22, securing frame assembly 20 upon vehicle seat back S.

Instant invention 10 may be utilized in vehicles such as automobiles, vans, trucks, campers, RVs and the like, where the seat for the driver or passengers does not have a built-in arm rest.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable arm rest, comprising:

A) a frame assembly having a first frame member with first and second ends and a second frame member with third and fourth ends, said first and second frame members each having a first slot with fifth and sixth ends extending a first predetermined distance from said first and third end, a second predetermined distance towards said second and fourth end respectfully, without reaching said second and fourth end, said fifth end includes a second slot with adjustment means, and said sixth end having a third slot with locking means, said first frame member further having an opening at said first end to receive said third end of said second frame member, said first frame member also having a through opening a third predetermined distance from said first end towards said second end, without reaching said second end;

B) an arm assembly having first and second arm members, each having a bushing extending radially outwardly a fourth predetermined distance, said bushing slidably journals within said first, second, and third slots, said bushing also includes a retainer to secure said bushing within said first, second, and third slots; and C) width adjusting means for adjusting the width of said frame assembly so that said frame assembly may be mounted onto a vehicle seat.

2. The portable arm rest set forth in claim 1, wherein said width adjusting means includes a knob, insertable through said through opening of said first frame member so that a user exerting a rotational force can secure said first frame member to said second frame member.

3. The portable arm rest set forth in claim 2, wherein said adjustment means includes said bushings swiveling and locking within said second slot, allowing said first and second arm members to rotate from a retracted position to an extracted position and vice-a-versa.

4. The portable arm rest set forth in claim 3, wherein said locking means includes said bushing fitting within said third slot, allowing said first and second arm members to lock in place.

* * * * *